US009113272B2

(12) United States Patent
Kurmann et al.

(10) Patent No.: US 9,113,272 B2
(45) Date of Patent: Aug. 18, 2015

(54) METHOD FOR ADJUSTING A HEARING DEVICE AND A HEARING DEVICE THAT IS OPERABLE ACCORDING TO SAID METHOD

(75) Inventors: Reto Kurmann, Stäfa (CH); Nicola Schmitt, Stäfa (CH); Volker Kühnel, Männedorf (CH); Andreas Von Buol, Zürich (CH); Elmar Fichtl, Üerikon (CH)

(73) Assignee: PHONAK AG, Stafa (CH)

( * ) Notice: Subject to any disclaimer, the term of this patent is extended or adjusted under 35 U.S.C. 154(b) by 0 days.

(21) Appl. No.: 13/879,078

(22) PCT Filed: Oct. 14, 2010

(86) PCT No.: PCT/EP2010/065409

§ 371 (c)(1),
(2), (4) Date: May 14, 2013

(87) PCT Pub. No.: WO2011/000973

PCT Pub. Date: Jan. 6, 2011

(65) Prior Publication Data

US 2013/0223662 A1 Aug. 29, 2013

(51) Int. Cl.
*H04R 25/00* (2006.01)

(52) U.S. Cl.
CPC ..... *H04R 25/50* (2013.01); *H04R 25/70* (2013.01); *H04R 2430/03* (2013.01)

(58) Field of Classification Search
CPC ..... H04R 25/70
USPC ..... 381/314, 312
See application file for complete search history.

(56) References Cited

U.S. PATENT DOCUMENTS 5,610,988 A 3/1997 Miyahara
7,068,802 B2 6/2006 Schulz et al.

(Continued)

FOREIGN PATENT DOCUMENTS

WO 00/65872 A1 11/2000
WO 2004/008801 A1 1/2004
WO 2009/039885 A1 4/2009

OTHER PUBLICATIONS

International Search Report for PCT/EP2010/065409 dated Jun. 29, 2011.

(Continued)

*Primary Examiner* — Curtis Kuntz
*Assistant Examiner* — Norman Yu
(74) *Attorney, Agent, or Firm* — Pearne & Gordon LLP

(57) ABSTRACT

The present invention is related to the adjusting of a hearing device (1) to the hearing preferences of a user of said hearing (1). The hearing device (1) comprises an input transducer (20) for providing an electrical signal that corresponds to an acoustical input signal, a processing unit (10) for processing the electrical signal according to a set of process parameters (G1, . . . , Gn) to provide an intermediate signal, and an output transducer (30) for providing an output signal to the user of said hearing device (1), wherein the output signal corresponds to the intermediate signal. The method comprises the step of providing a set of adjustment parameters (A1, . . . , Am), which, at least partly, represents an individual hearing characteristic of the user of said hearing device (1) and the further step of adapting the set of process parameters (G1, . . . , Gn) as a function of an adjustment control signal (ACS) and the set of adjustment parameters (A1, . . . , Am).

9 Claims, 1 Drawing Sheet

(56) References Cited

U.S. PATENT DOCUMENTS

2002/0076072 A1* 6/2002 Cornelisse ..... 381/312
2006/0222194 A1* 10/2006 Bramslow et al. ..... 381/314
2006/0245610 A1* 11/2006 Chalupper ..... 381/321
2011/0051942 A1* 3/2011 Wilson ..... 381/60

OTHER PUBLICATIONS

Written Opinion for PCT/EP2010/065409 dated Jun. 29, 2011.

* cited by examiner

METHOD FOR ADJUSTING A HEARING DEVICE AND A HEARING DEVICE THAT IS OPERABLE ACCORDING TO SAID METHOD

TECHNICAL FIELD OF THE INVENTION

The present invention is related to a method for adjusting a hearing device to the hearing preferences of a user of said hearing device and to a hearing device that is operable according to said method.

BACKGROUND OF THE INVENTION

It is known that an output sound volume of hearing devices often needs adjustments to the preferences of a user of said hearing device. For example in a noisy environment, a user may prefer a lower output volume, whereas in order to follow a conversation the user may prefer a higher output volume. Therefore, hearing devices usually comprise a means that allows the user to adjust the output volume.

For example, U.S. Pat. No. 5,610,988 discloses a hearing aid with a user controllable adjusting dial. Thereby, a received sound signal is processed according to a gain level and forwarded to a loudspeaker to provide a sound signal to the user. In order to adjust the output volume, the user can adjust the gain level of the signal processing by manually activating an adjusting dial, which is marked with numerals that indicate the corresponding gain level.

SUMMARY OF THE INVENTION

The present invention has the objective to propose an improved method for adjusting a hearing device to the hearing preferences of a user and to propose an improved hearing device that is operable according to said method.

This objective is reached by a method comprising the features specified in claim 1. Further embodiments of the method according to the present invention as well as a hearing device according to the present invention are specified in further claims.

Under a hearing device, a device is understood, which is worn in or adjacent to the user's ear with the object to improve the user's acoustical perception. Such an improvement may also be barring acoustic signals from being perceived in the sense of hearing protection for the user. If the hearing device is tailored so as to improve the perception of a hearing impaired user towards hearing perception of a user with normal hearing ability, then the hearing device is regarded as a hearing-aid. With respect to the application area, a hearing device may be applied behind the ear, in the ear, completely in the ear canal or may be implanted.

In particular, the invention proposes a method for adjusting a hearing device to the hearing preferences of a user of said hearing device, wherein the hearing device comprises an input transducer for providing an electrical signal that corresponds to an acoustical input signal, a processing unit for processing the electrical signal according to a set of process parameters to provide an intermediate signal, and an output transducer for providing an output signal to the user of said hearing device, wherein the output signal corresponds to the intermediate signal. The method comprises the step of providing a set of adjustment parameters, which, at least partly, represents an individual hearing characteristic of the user of said hearing device and the further step of adapting the set of process parameters as a function of an adjustment control signal and the set of adjustment parameters.

According to the invention, the dependency from the user control in combination with the individual hearing characteristic of the user enables precise and effective adjustments, which, in turn, provides to the user improved hearing sensations and/or comfortable adjustment operations.

In particular, the invention reaches the objective by providing a user control that takes into account the individuality of the user. For example, a 2-dB volume change usually gives different subjective hearing sensations to different persons with different hearing abilities. Consequently, with the method and the hearing device according to the invention, individually optimized adjustments can be carried out in order to provide an optimum hearing perception to the user.

Thus, by taking into account the hearing individuality of the user, the invention proves to be surprisingly effective for providing highly precise and fine graded as well as comfortable and convenient adjustments of the hearing device to the user preferences.

Furthermore, with a method according to the invention, the hearing device is adaptable to a wide range of different users, which, in turn, allows for a cost effective manufacturing of the hearing devices in large numbers as well as an efficient logistic, distribution and service of the hearing devices.

The number n is the number of process parameters within the set of process parameters and the number m is the number of adjustment parameters within the set of adjustment parameters.

In one example, the set of process parameters and/or the set of adjustment parameters comprises one or more parameters. Consequently, the number n of the process parameters and/or the number m of the adjustment parameters are natural numbers equal or greater than 1.

In a further example, the set of process parameters and/or the set of adjustment parameters comprises a plurality of parameters. Therefore, the number n of the process parameters and/or the number m of the adjustment parameters are natural numbers equal or greater than 2.

In a further example, the adjustments possibilities are equal or smaller that the processing complexity, such that the number n of the process parameters is equal or larger than the number m of the adjustment parameters.

The parameters of the set of process parameters and/or the set of adjustment parameters may be used for processing different signal components or different characteristics of the electrical signal. For example, the parameters may relate to frequency components, feedback thresholds, processing timings or echo cancellations. Further, the parameters may be expressed in many different ways, in particular as positive, negative, rational, irrational or complex numbers.

The set of process parameters and/or the set of adjustment parameters may also be defined as a list of components, such as a vector. The set may also comprise a plurality of subsets, wherein each subset may comprise a plurality of parameters, such that the set may be similar to a matrix structure comprising a plurality of vectors. A set of process parameters and/or a set of adjustment parameters comprising a number of seven components has shown a good relation between processing quality and processing effort.

Further, the set of process parameters and/or the set of adjustment parameters is usually provided as a predetermined set that is ready for use in processing operations or adjustment operations respectively. To this end, these sets of parameters may be provided by different means, for example as values that are read from a memory or as pre-calculated intermediate values provided by a calculation unit.

The values of the adjustment parameters may be determined by a hearing specialist, in particular an audiologist during an adjustment initialization phase. This adjustment initialization phase can be combined with the main initialization phase of the hearing device, which is known as fitting. During the fitting the hearing device is initiated and adapted to the individual hearing characteristics of the user. Likewise, the adjustment parameters may also be determined. In particular, the adjustment parameters may be derived from individual user data such as audiograms, data related to a hearing loss, to the dynamic range of the user or to user specific sound situations. Further, the set of adjustment parameters may be fine tuned in a later phase, e.g. after the adjustment initialization phase, the fitting or a test phase.

The set of adjustment parameters is usually configured into the hearing device, in particular by writing the adjustment parameters into a non-volatile memory being part of the hearing device.

An initial set of adjustment parameters may also be configured into the hearing device during its manufacturing. In a later phase, for example during the fitting, the initial set may then be adapted to the individual hearing characteristics of the user. However, it is also possible to transmit the relevant user data to the manufacturer for individually pre-configuring the hearing device during its manufacturing.

In addition, the set of adjustment parameters can be saved in the hearing device with very low requirements for storage space. For example, a slow memory with a storing capacity of seven numbers can be sufficient. Further, the additional processing of the set of adjustment parameters hardly requires any computing power. These low requirements for storage and computing power are particularly advantageous for hearing devices, which typically dispose of limited resources only.

The input and output transducers convert an acoustical input signal to an electrical signal or vice versa and can be implemented by a great variety of devices. Typically, the transducers are sound transducers such as microphones or loudspeakers, which may be based on electromagnetic, electrodynamic, electrostatic, piezoelectric or piezoresistive principles. The input transducer can also embraces remote devices such as remote microphones, stationary or mobile telephones, which receive and converted an acoustical input signal remotely and transmit the converted signal to the processing unit of the hearing device via a wire or wireless connection. Further, the output transducer may also convert the intermediate signal into a mechanical signal such as mechanical vibrations. The mechanical signal may then be applied directly to the hearing bone of the user. It may also be possible to convert the electrical signal into a further electrical signal that is applied directly to the acoustic organ of the user, e.g. by using a cochlear implant.

The processing unit is typically implemented by a digital component such as a digital filter or a DSP (Digital Signal Processor). However, analog components may also be used. The processing unit may be a programmable unit, for example a microprocessor or a FPGA, but it could also be implemented by using fixed wired circuits, for example discrete electronic components or ASICs (application specific integrated circuit).

In a first embodiment of the method according to the invention, the method comprises the step of adapting the set of process parameters in a plurality of frequency bands. This enables particularly effective adaptation to the hearing characteristic of the user, which is often highly frequency-dependent.

In order to carry out frequency-dependent processing, each of the parameter of the set of process parameters may be related to a frequency band, wherein the frequency band is defined by a predetermined frequency range within the spectrum of the electrical signal. With frequency selective means, a component of the electrical signal that relates to a particular frequency band can be processed substantially separately from the other signal components. Thereby, the substantially separate processing within the particular frequency band is carried out according to the related process parameter. After the processing, the separately processed signal components can be combined to provide the intermediate signal.

In an embodiment according to the invention, the selective means are implemented by a digital and/or an analog filter, wherein the processing is carried out in a time domain and/or a frequency domain. In particular, a Fourier transformation is carried out to transform the electrical signal from the time domain to the frequency domain.

For implementing a frequency-dependent adjustment according to the above mentioned embodiment of the invention, the parameters of the set of adjustment parameters may be related to corresponding process parameters. This way, the adjustment within one of the frequency bands can be controlled substantially separately from the other frequency bands and within that frequency band the adjustment is controlled according to the corresponding adjustment parameter that represents, at least partly, the hearing characteristic of the user within that frequency band. The frequency-dependent adjustment can be carried out for each of the frequency bands, in particular by parallel processing.

The number of frequency bands may be chosen to cover the frequency range that is relevant for hearing. In addition, the distribution of the frequency bands may be chosen in many different ways, for example as being linear, exponential or logarithmical. Good results have been achieved with a number of seven frequency bands, which are defined according to a number of seven frequency ranges, wherein each frequency range embraces a frequency of 125 Hz, 250 Hz, 500 Hz, 1000 Hz, 2000 Hz, 4000 Hz and 8000 Hz respectively.

In a further embodiment of the method according to the invention, the method comprises the step of forwarding an adjustment command as adjustment control signal, wherein the adjustment command is a scalar value. This scalar value is a single control value that may represent a single number, an on-off command or a counter value. This provides a clear and convenient user control by reducing multiple, possibly interacting parameters to a single control value, whereas the control of multiple parameters may be overwhelmingly complex.

In a further embodiment of the method according to the invention, the adjustment command is provided by the user of said hearing device via a user interface. The latter may be implemented by a device for manual operation such as a dial, a switch, wheel or a pad. Further, the interface may be located on a remote control or on a component of the hearing device that is located near the ear of the user.

In a further embodiment of the method according to the invention, the set of process parameters is a set of gains, which controls an amplification or an attenuation of the electrical signal, in particular within a plurality of frequency bands. This provides for efficient processing of the electrical signal, particularly in the case of complex processing operations.

The gains can be defined as numbers, in particular as real or complex numbers, for use in digital filters. They may also represent analog build blocks with active or passive electronic components, e.g. operational amplifiers, resistances, capacitances or inductances or any combination thereof.

In a further embodiment of the method according to the invention, the set of process parameters is additionally adapted as a function of at least one of:

a) an acoustical coupling of the hearing device to the user;
b) a hearing asymmetry between the left ear and the right ear of the user;
c) an acoustical situation of the user;
d) a feedback threshold.

These additional dependencies allow for a further tuning of the adjustments according to the individual hearing characteristic of the user.

In a further embodiment of the method according to the invention, each of the process parameters is adapted according to a uniquely assigned adjustment parameter. This provides a clear structure as well as an efficient way to adapt the process parameters.

In a further embodiment of the method according to the invention, the set of process parameters is adjusted by adding a set of increments that is a function of the adjustment control signal and the set of adjustment parameters. These increments allow for an effective processing of precise adjustments and may help to save storage space.

Generally, the absolute values of the increments are smaller than the absolute values of the process parameters and therefore only small increments occur in response to the adjustment control signal. Usually, the storage of small numbers representing the small increments needs less storage space. Further, the values of the increments may also be negative, such that an increment in effect is a decrement or that the addition of the increment in effect is a subtraction of the absolute value of the increment.

In a further embodiment of the method according to the invention, at least two, in particular all, of the process parameters of the set of process parameters are adjusted substantially simultaneously. This enables an efficient processing and minimizes processing errors that may be caused by transient state changes.

In a further embodiment of the method according to the invention, the set of process parameters is adjusted in a stepwise manner, in particular according to a step counter value. This enables comfortable and reproducible adjustments of the hearing device. Good results have been achieved with steps in a range of −3 to +5.

In a further embodiment of the method according to the invention, an individual process parameter Gi of the set of process parameters is controlled according to the expression:

$$Gi=G0i+scv*Ai, \text{ with } 1\leq i\leq n,$$

wherein i is an index, n is the number of process parameters (G1, . . . , Gn), G0i is an individual element of a set of predetermined gain values G01, . . . , G0n, scv is the step counter value and Ai is an individual adjustment parameter of the set of adjustment parameters A1, . . . , An.

The predetermined gain values G01, . . . , G0n may be determined, during an initiation phase, in which the hearing device is initiated and adapted to the individual hearing characteristics of the user, for example during the fitting.

The processing according to the above expression provides for efficient adjustments by carrying out simple mathematical operations. This is particularly important for hearing devices with limited processing power.

In a further embodiment of the method according to the invention, the set of process parameters is additionally adapted as a function of a scaling factor, which in particular is at least one of:

an integer number;
a rational number;
a number that depends on the direction of the adjustment.

With said scaling factor, the adjustment range can be effectively adapted to the individual needs and/or preferences of the user without significantly increasing storage space and/or computing power requirement.

In a further embodiment of the method according to the invention, the set of process parameters is additionally adapted as a function of at least one of:

an adjustment step size;
an adjustment direction;
a momentary sound situation;
a level of the acoustical input signal.

These additional dependencies allow for a particularly precise and fine tuning of the adjustments to the individual needs and/or preferences of the user.

The consideration of the additional dependencies can be implemented by storing different sets of process parameters or adjustment parameters in a memory of the hearing device. In order to carry out adjustments, a set of parameters may be chosen that is most appropriate for the above mentioned situations. For example, for better speech intelligibility a parameter set with increased middle frequencies is preferable, whereas for listening music a parameter set with a flat frequency characteristic may produce better results. Further, by considering the level of the acoustical input signal a low acoustic signal may be processed with higher amplification than a loud acoustic signal. Of course, all the above mentioned dependencies can be combined to provide a optimized adjustment of the hearing device.

In a further embodiment of the method according to the invention, the set of adjustment parameters is derived from a hearing loss and/or a dynamic range of the user of said hearing device. This is particularly advantageous because hearing losses and/or dynamic ranges are very specific to the individual user, and therefore individual adjustments provide an optimum hearing perception and comfortable adjustments to a wide range of users.

In a further embodiment of the method according to the invention, the set of process parameters is implemented, such that the adapting of the process parameters controls the volume sensation experienced by the user. The volume sensation is one of the most important criteria to the user's comfort and therefore individual adjustments according to the invention provide an effective and fast adjustment of the hearing device.

The invention further proposes a hearing device that is operable according to the aforementioned method and their embodiments.

In particular, the invention proposes a hearing device comprising a processing unit that is operationally connected to an input transducer for receiving an electrical signal that corresponds to an acoustical input signal. The processing unit is operable to provide an intermediate signal by processing the electrical signal according to a set of process parameters and to adapt the process parameters as a function of an adjustment control signal. The hearing device further comprises an output transducer that is operationally connected to the processing unit for receiving the intermediate signal and that is operable to provide an output signal to the user of said hearing device, wherein the output signal corresponds to the intermediate signal. The processing unit is operable to additionally adapt the process parameters as a function of a set of adjustment parameters, which, at least partly, represents an individual hearing characteristic of the user of said hearing device.

The hearing device may comprise of several components, which are operationally connectable and which may be located at different places. Typically, said components are meant to be worn or carried by the user. For example, the components of the hearing device can be components for the left or the right ear of the user, a remote control, a remote input transducer or a remote output transducer.

In a further embodiment of the device according to the invention, the device comprises a user interface that is operationally connected, in particular via a step counter, to the processing unit for forwarding an adjustment command as adjustment control signal, wherein the adjustment command is provided by the user of said hearing device.

In a further embodiment of the device according to the invention, the device comprises a memory that is adapted to store the adjustment parameters and that is operationally connected to the processing unit for providing the adjustment parameters to the processing unit. The memory allows a flexible changing of the adjustment parameters during the fitting and enables fast and simple processing during adjustment operations. In particular, the memory is non-volatile to prevent a loss of the stored adjustment parameters in the case of a power supply disruption.

In a further embodiment of the device according to the invention, the device is a hearing-aid or a hearing protection device. For these devices, adjustments that take into account the individual hearing characteristic of the user are particular advantageous because this enables the devices to cover a wide range of different hearing impairments and/or user specific sound situations.

It is expressly pointed out that any combination of the above-mentioned embodiments, or combinations of combinations, is subject to a further combination. Only those combinations are excluded that would result in a contradiction.

BRIEF DESCRIPTION OF THE DRAWINGS

Below, the present invention is described in more detail by means of exemplary embodiments and the included drawings. It is shown in.

BRIEF DESCRIPTION OF THE INVENTION

The described embodiments are meant as illustrating examples and shall not confine the invention.

Figure 1:
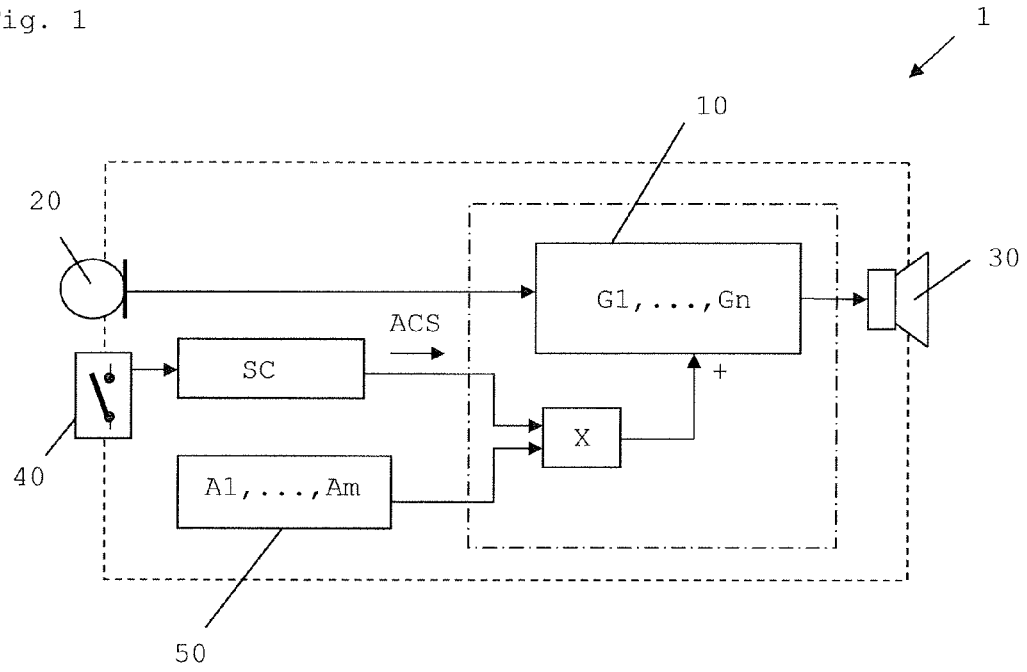
FIG. 1 a simplified block diagram illustrating an embodiment of a hearing device according to the invention.

FIG. 1 shows a simplified block diagram that illustrates an embodiment of a hearing device 1 according to the invention. The hearing device 1 comprises a microphone 20 that serves as input transducer, a processing unit 10 and a sound transducer 30, e.g. a loudspeaker that serves as output transducer. The processing unit 10 is connected on its input side to the microphone 20 for receiving an electrical signal and on its output side to the sound transducer 30 for providing an electrical output signal as intermediate signal.

The transducers 20 or 30 may also be operationally connected to the processing unit 10, wherein the term "operationally connected" is understood in the meaning that the operation of a further device that is connected to a first device depends on the operation of this first device, even with the presence of one or more interconnected devices.

The processing unit 10 is configured to provide a set of process parameters, which is implemented, for example, as a set of gains G1, . . . , Gn comprising n components. Each of the gains G1, . . . , Gn may relate to a frequency band within the spectrum of the electrical signal and each of the gains G1, . . . , Gn may control an amplification or an attenuation of the electrical signal within the related frequency band. It is readily understood that the amplification or the attenuation may also include a phase shift with constant amplitude.

Particularly, by means of filters (not shown), a component of the electrical signal that relates to a particular frequency band can be processed substantially separately from the other signal components of the electrical signal. Thereby the frequency band is defined by a predetermined frequency range within the spectrum of the electrical signal. The separated component can be processed according to a gain Gi that corresponds to the related frequency band, wherein Gi is a single component out of the set of gains G1, . . . , Gn. After the processing, the separately processed signal components can be combined to provide the intermediate signal.

In normal operation of the hearing device, the microphone 20 provides an electrical signal that corresponds to an acoustical input signal. The processing unit 10 receives this electrical signal and processes it according to the set of gains G1, . . . , Gn to provide the intermediate signal. The sound transducer 30 receives the intermediate signal and provides a sound signal to the user of the hearing device 1, wherein this sound signal is an output signal that corresponds to the intermediate signal.

For the adjusting of the hearing device 1, the hearing device 1 further comprises a switch 40 as a user interface, a step counter SC, a multiplier X for carrying out a multiplication and a memory 50 that is configured to store a set of adjustment parameters A1, . . . , Am.

The set of adjustment parameters A1, . . . , Am represents, at least partly, an individual hearing characteristic of the user of hearing device 1. Further, the set of adjustment parameters A1, . . . , Am comprises a number of m individual adjustment parameters Ai, each being uniquely assigned to one of the n process parameters G1, . . . , Gn, such that the number m of the adjustment parameters A1, . . . , Am is equal to the number n of the process parameters G1, . . . , Gn.

The switch 40 is operationally connected via a step counter SC to a first input of multiplier X for providing an adjustment control signal ACS. The memory 50 is connected to a second input of multiplier X for transmitting the set of adjustment parameters A1, . . . , Am to the multiplier X. The output of multiplier X is connected to the processing unit 10 for transmitting results of the multiplication.

For adjusting the hearing device 1 to the hearing preferences of the user of the hearing device 1, the user provides an adjustment command by manually activating the switch 40. This activation is forwarded to the step counter SC, where it increases or decreases a step counter value scv. For example, upon receiving an adjustment command, the step counter SC may change its step counter value scv from +3 to +4. The step counter 50 forwards the adjustment control signal ACS to the multiplier X, wherein the adjustment control signal ACS represents the momentary step counter value scv.

The multiplier X multiplies the received step counter value scv with the received adjustment parameters A1, . . . , Am and transmits the multiplication result to the processing unit 10, where the multiplication result is added to the set of gains G1, . . . , Gn. This addition operation is indicated in FIG. 1 by a plus sign. However, depending on the sign of the adjustment parameters A1, . . . , Am or the sign of the step counter value scv, the addition can in effect also be a subtraction.

In summary, according to this embodiment, the individual process parameters Gi of the set of process parameters are controlled according to the expression:

$$Gi=G0i+scv*Ai,\ with\ 1\leq i\leq n,$$

wherein i is an index and G0i is an individual element of a set of predetermined gain values G0i, . . . , G0n. For example, the predetermined gain values G0i, . . . , G0n may be determined during the initiation phase, e.g. during the fitting, and written into the memory 50 for use in a later phase for the adjusting of the hearing device 1.

In this case the set of process parameters G1, . . . , Gn is adjusted by adding a set of increments, namely the set of n factors scv*Ai, with $1 \leq i \leq n$. Therefore the set of increments is a function of the step counter value scv and the set of adjustment parameters A1, . . . , Am. Consequently and according to the invention, the set of process parameters G1, . . . , Gn is adapted as a function of step counter value scv and the set of adjustment parameters A1, . . . , Am.

As indicated by the dashed line, hearing device 1 may be implemented as a compact device that comprises all the above mentioned components. However, hearing device 1 may also comprise separated components such as separated building elements that are operationally connected together, for example a remote user interface, a remote processing unit, a remote microphone or a remote sound transducer. Further, multiplexer X may be integrated into processing unit 10 as indicated by the dash-dotted line. In addition, step counter SC and/or memory 50 may also be integrated into processing unit 10.

It is readily understood that the constituents of the shown embodiments are at least in part merely functional units, which of course can be arranged in various ways, e.g., two or more of them can be united in one physical unit, or one or more of them can be distributed over two or more physical units. Further, many of these functions may be implemented in form of software, e.g. as a program that is executable on a processor such as a signal processor or a microprocessor.

According to the invention, the disadvantages of the prior art, namely the direct control of the gain level by the user, is avoided. The direct control of the gain level, a so called scalar gain offset, adversely affects the output volume, because the adjustment of the output volume depends on the setting of the volume adjusting dial only, such that the gains at all frequencies are shifted in parallel. Consequently, by the direct control of the gain level the output volume can only be changed by simple, possibly inappropriate way, which frequently appears to the user as being either insensitive or hypersensitive. This may cause uncomfortable hearing sensations and/or cumbersome adjustment operations.

Figure 2:
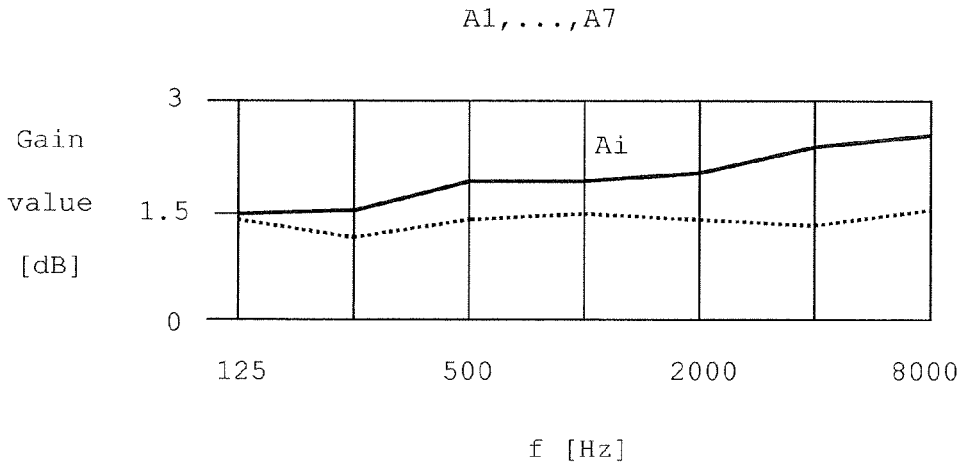
FIG. 2 a diagram of two exemplary sets of adjustment parameters A1, . . . , A7 for use in a hearing device according to FIG. 1.

FIG. 2 shows a diagram of two exemplary sets of adjustment parameters A1, . . . , A7, which can be used in the hearing device according to FIG. 1. The x-axis of the diagram indicates the gain value of the adjustment parameters A1, . . . , A7 in the range of 0 to 3 dB. The y-axis of the diagram indicates frequencies that are related to the adjustment parameters A1, . . . , A7. The frequencies of the seven adjustment parameters A1, . . . , A7 are assigned to 125 Hz, 250 Hz, 500 Hz, 1000 Hz, 2000 Hz, 4000 Hz and 8000 Hz respectively (for clarity, only 125 Hz, 500 Hz, 2000 Hz and 8000 Hz are shown).

The first exemplary set is indicated by a solid line. The values of the adjustment parameters A1, . . . , A7 of this first set increase with increasing frequency from approx. 1.5 dB at 125 Hz for adjustment parameter A1 to approx. 2.5 dB at 8000 Hz for adjustment parameter A7 (for clarity, only a representative adjustment parameter Ai is indicated). The first set of adjustment parameters may belong to a first user and represents, at least partly, the individual hearing characteristic of that first user.

The second exemplary set of adjustment parameters is indicated by a dotted line. The second set of adjustment parameters may belong to a second user. Similarly, the second set of adjustment parameters represents, at least partly, the individual hearing characteristic of the second user.

By nature of the individual hearing abilities of the different users, the user dependent sets of adjustment parameters A1, . . . , A7 and the corresponding lines in the diagram are completely different. Thus, the same user manipulation for adjusting the hearing device will have a completely different effect to the first user then to the second user. It is readily understood that the first and second set of adjustment parameters may also belong to different ears of the same user.

The invention claimed is:

1. A method for adjusting a hearing device (1) to the hearing preferences of a user of said hearing device (1), the hearing device (1) comprising an input transducer (20) for providing an electrical signal that corresponds to an acoustical input signal, a processing unit (10) for processing the electrical signal according to a set of process parameters (G1, . . . , Gn) to provide an intermediate signal, and an output transducer (30) for providing an output signal to the user of said hearing device (1), the output signal corresponding to the intermediate signal, said method comprising the steps of:

providing a set of adjustment parameters (A1, . . . , Am), which, at least partly, represents an individual hearing characteristic of the user of said hearing device (1);

adapting the set of process parameters (G1, . . . , Gn) as a function of an adjustment control signal (ACS) and the set of adjustment parameters (A1, . . . , Am); and adapting the set of process parameters (G1, . . . , Gn) in a plurality of frequency bands, wherein the set of process parameters (G1, . . . , Gn) is adjusted in a stepwise manner, in particular according to a step counter value (scv), and, wherein an individual process parameter Gi of the set of process parameters (G1, . . . , Gn) is controlled according to the expression:

$$Gi=G0i+scv*Ai, \text{ with } 1 \leq i \leq n, \text{ and}$$

wherein i is an index, n is the number of process parameters (G1, . . . , Gn), G0i is an individual element of a set of predetermined gain values (G01, . . . , G0n), scv is the step counter value and Ai is an individual adjustment parameter of the set of adjustment parameters (A1, . . . , Am).

2. The method according to claim 1, comprising the step of forwarding an adjustment command as adjustment control signal (ACS), the adjustment command being a scalar value.

3. The method according to claim 2, wherein the adjustment command is provided by the user of said hearing device (1) via a user interface (40).

4. The method according to claim 1, wherein the set of process parameters (G1, . . . , Gn) is a set of gains, which controls an amplification or an attenuation of the electrical signal within a plurality of frequency bands.

5. The method according to claim 1, wherein the set of process parameters (G1, . . . , Gn) is additionally adapted as a function of at least one of:

a) an acoustical coupling of the hearing device (1) to the user;

b) a hearing asymmetry between the left ear and right ear of the user;

c) an acoustical situation of the user;

d) a feedback threshold.

6. The method according to claim 1, wherein each of the process parameters (G1, . . . , Gn) is adapted according to a uniquely assigned adjustment parameter (A1, . . . , Am).

7. The method according to claim 1, wherein the set of process parameters (G1, . . . , Gn) is adjusted by adding a set of increments that is a function of the adjustment control signal (ACS) and the set of adjustment parameters (A1, . . . , Am).

8. The method according to claim 1, wherein the set of process parameters (G1, . . . , Gn) is additionally adapted as a function of a scaling factor, which in particular is at least one of:

an integer number;

a rational number;

a number that depends on the direction of the adjustment.

9. The method according to claim 1, wherein the set of process parameters (G1, . . . , Gn) is additionally adapted as a function of at least one of:

an adjustment step size;

an adjustment direction;

a momentary sound situation;

a level of the acoustical input signal.

* * * * *